US005592846A

United States Patent [19]

Watanabe et al.

[11] Patent Number: 5,592,846

[45] Date of Patent: Jan. 14, 1997

[54] ENDLESS HOT ROLLING METHOD

[75] Inventors: Yuichiro Watanabe; Kunio Isobe; Ikuo Yarita; Hideyuki Nikaido, all of Chiba, Japan

[73] Assignee: Kawasaki Steel Corporation, Kobe, Japan

[21] Appl. No.: 101,860

[22] Filed: Aug. 4, 1993

[30] Foreign Application Priority Data

Aug. 7, 1992 [JP] Japan ..... 4-211710
Aug. 7, 1992 [JP] Japan ..... 4-211711

[51] Int. Cl.[6] ..... B21B 1/26

[52] U.S. Cl. ..... 72/206; 72/241.8; 72/247

[58] Field of Search ..... 72/206, 234, 247, 72/241.8, 365.2, 366.2

[56] References Cited

U.S. PATENT DOCUMENTS

| | | | |
|---|---|---|---|
| 4,703,641 | 11/1987 | Yarita et al. | 72/247 |
| 4,773,246 | 9/1988 | Perret | 72/247 |
| 4,823,585 | 4/1989 | Hishinuma et al. | 72/247 |
| 4,864,836 | 9/1989 | Ochiai | 72/247 |
| 5,323,951 | 6/1994 | Takechi et al. | 72/202 |

*Primary Examiner*—Daniel C. Crane
*Assistant Examiner*—Thomas C. Schoeffler
*Attorney, Agent, or Firm*—Dvorak and Traub

[57] ABSTRACT

Herein disclosed is an endless hot rolling method using a hot strip mill substantially composed of a roughing mill and a finishing mill having a roll bender and a roll shifter to continuously roll sequentially joined different rolling materials. The method comprises the steps of: calculating a roll shift range in an axial direction for each rolling material so as to provide a desired crown; determining a rolling sequence so as to obtain a common roll shift range for each pair of neighboring rolling materials; connecting a preceding material at the tail end thereof to the head end of the succeeding material, between the roughing mill and the finishing mill; shifting the rolls during transition from the preceding material to the succeeding material so that the roll position corresponding to the joint of the two materials is within a common roll shift range for the materials; and changing the roll bending load in accordance with the roll shift pattern so as to achieve the desired crown of each material. If the width of a common roll shift range for all the materials is at least 50% of the width of the individual roll shift ranges, rolling can be continuously performed without shifting in an axial direction rolls.

3 Claims, 8 Drawing Sheets

ENDLESS HOT ROLLING METHOD

BACKGROUND OF THE INVENTION

1. Field of the Invention

The present invention relates to an endless hot rolling method for continuously rolling sequentially-jointed rolling materials (the "rolling materials" are referred to hereinunder as "rolling materials" for pieces before and during rolling, and "steel strip" for pieces after finishing rolling), the rolling materials differing from each other in any of width, thickness or steel type. More particularly, the invention relates to an endless finishing hot-rolling method which provides an appropriate amount of crown for each steel strip so as to substantially avoid forming inconsistent portions.

2. Description of the Related Art

To achieve thickness consistency over the width of a steel strip by controlling crown, the roll bending method has been widely employed. However, employment of this method alone is insufficient to control crown precisely enough to achieve a currently required level of thickness precision which has become ever-increasingly higher.

To enhance the crown control, Japanese Patent Publication No. 56-20081 discloses a rolling mill which axially shifts a roll having a tapered end portion, and Japanese Patent Application Laid-open No. 56-30014 discloses a so-called CVC shift mill which relatively shifts upper and lower rolls having wave-shape crowns. Such roll shifting method is now used together with the roll bending method to achieve precise crown control.

A known six-high finishing hot-rolling mill employing both the roll shifting method and the roll bending method will be described with reference to FIGS. 5 and 6.

The mill comprises a pair of work rolls 2 for applying rolling load to a rolling material 1, a pair of intermediate rolls 3 each having a tapered end portion, and a pair of back-up rolls 4. The work rolls 2 are vertically movable by means of roll benders 9 which are operated by hydraulic cylinders. The intermediate rolls 3 are axially movable by means of racks and pinions (not shown in figures).

To consecutively roll two rolling materials differing from each other in any of width, thickness or steel type, the above-described rolling mill suspends the rolling operation after completing rolling the preceding (first) material, shifts in an axial direction the intermediate rolls 3 to designated positions, and then rolls while changing the load for bending the work rolls 2 to control the crown shape of the succeeding (second) material.

Lately, so-called endless hot-rolling is employed to enhance the efficiency of hot finishing tandem rolling as described above. In endless hot-rolling, a mill continuously rolls materials different in width, thickness and steel type, after the rolling materials have been sequentially joined together.

To achieve desired crowns in endless hot-rolling, the roll bending load and the roll shift position must be changed in accordance with the dimensions and steel types of the steel strip. However, although the roll bending load can be changed quickly and highly responsively owing to the hydraulic control of a roll bender, the shifting rate of the roll position is very slow. Therefore, when the roll is shifted in the axial direction, particularly, at a joint portion of rolling materials, the crown thereof substantially deviates from a desired crown, thus forming inconsistent portions in the steel strip.

To avoid forming such inconsistent portions, Japanese Patent Application Laid-open No. 62-3818 discloses an improved method for continuously rolling material having different plate widths, the rolling materials having been joined together before rolling. This method comprises the steps of: measuring the width of rolling materials adjacent to a joint portion; shifting the roll position in the axial direction in accordance with the width thus measured, or more specifically, to the difference between the width measured adjacent to the joint portion and a width of other portions of rolling material; and then rolling while changing the roll bending load so as to constantly achieve a desired crown.

However, this method has problems related to the roll shift range occurring during transition from a preceding material to a succeeding material. By this method, the rolls are sometimes shifted out of a desired roll shift range. If this happens, this method undergoes the problems discussed above, that is, many inconsistent portions are formed adjacent to joint portions of steel strips.

SUMMARY OF THE INVENTION

An object of the this invention is to construct a rolling cycle capable of achieving a suitable shift of rolls in the axial direction, whose responsiveness is comparatively slow as described above, thereby substantially avoiding forming inconsistent portions adjacent to joint portions of steel strips.

Accordingly, the present invention provides an endless hot rolling method using a hot strip mill substantially composed of a roughing mill and a finishing mill having roll bending means and roll shifting means to continuously roll different rolling materials which have been sequentially joined together, the endless hot rolling method comprising the steps of:

calculating a roll shift range in the axial direction for each rolling material so as to provide a desired crown for the rolling material;

determining a rolling sequence so as to obtain a common roll shift range in the axial direction for each pair of neighboring rolling materials;

connecting a preceding rolling material at the tail end thereof to the head end of the succeeding rolling material, between the roughing mill and the finishing mill;

shifting in the axial direction the roll position during transition from a preceding material to a succeeding material so that the roll shift position corresponding to the connecting point of the preceding material and the succeeding material is within a common roll shift range in the axial direction for the preceding material and the succeeding material; and rolling while changing the roll bending load in accordance with the roll shift pattern so as to achieve the desired crown of each rolling material.

DETAILED DESCRIPTION OF THE PREFERRED EMBODIMENTS

The distribution of the thicknesses of rolling strip is generally estimated by a simulation called divided model. This technique calculates, on the basis of rolling load, amounts of bending and compression of the rolls occurring when a rolling material deforms, and calculates the distribution of the strip thicknesses based on the initial crown, thermal crown and abrasion loss of the rolls.

The rolling load is determined by various rolling conditions, such as, the tension, the strip thickness, the strip width, the roll diameter, and the deformation resistance of a rolling material. The thermal crown of the rolls can be determined by using a heat conduction model based on finite differences of friction heat, heat generated by plastic processing, heat conducted from a rolling material, etc., in addition to data acquired from estimations and actual operations in the past. The abrasion loss of the rolls can be determined based on the rolling length, the rolling load, the roll diameter and the material of the rolls, in addition to data acquired from estimations and actual operations in the past.

Figure 1:
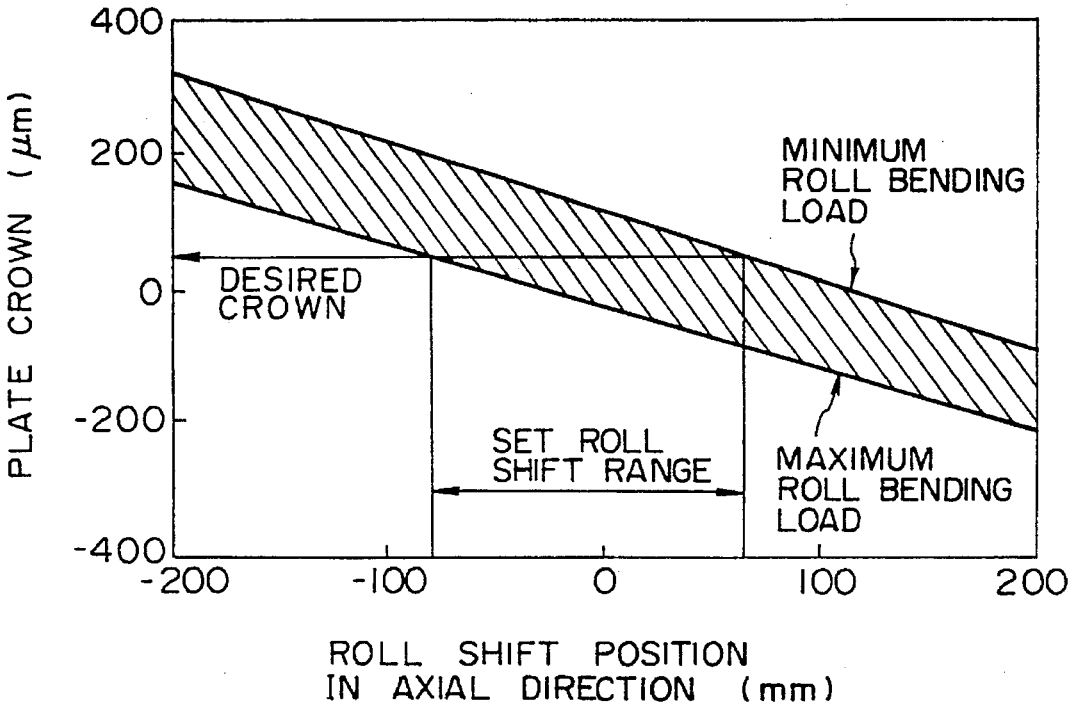
FIG. 1 is a graph indicating the relation among the plate crown, the roll shift position in the axial direction and the bending load.

As shown in FIG. 1, the above-described technique considers the relation of the roll position, the roll bending load and the plate crown in a shift mill, based on the rolling conditions and the initial crowns of the rolls. As indicated by the graph of FIG. 1, if a particular crown is desired, the roll shift range in the axial direction for obtaining the desired crown is determined from the roll bending load range between the maximum and minimum loads. In other words, if the roll shift position is set within the roll shift range, the desired crown on a rolling material can be achieved by the roll bending means of the shift mill.

As described above, while a roll bender is highly responsive and requires only a short time to change the roll bending load, the shift of roll position in the axial direction is poorly responsive and, therefore, it is impossible to instantly shift the roll position at a joint portion of rolling materials.

Figure 2:
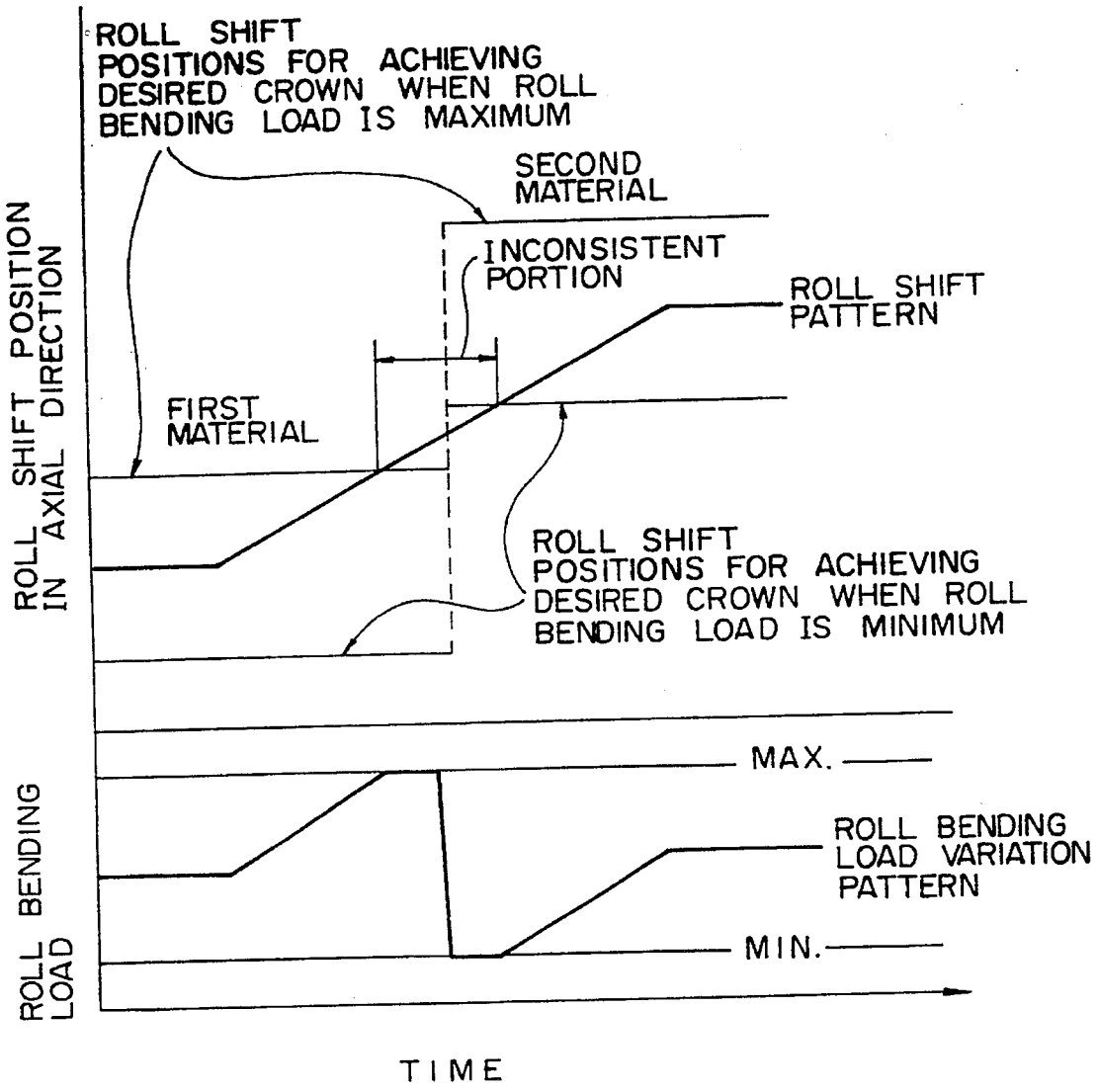
FIG. 2 is a graph indicating roll shift ranges allowing for desired crowns for neighboring rolling materials, and a roll shift pattern determined substantially within the roll shift ranges, and a roll bending variation pattern in accordance with the roll shift pattern, when there is no common roll shift range for the neighboring materials.

Therefore, if there is no common roll shift range for neighboring materials as indicated in FIG. 2, any roll shift pattern will form an inconsistent portion having a crown deviated from a desired crown, on a preceding material or the succeeding material, or adjacent to a joint portion thereof.

Figure 3:
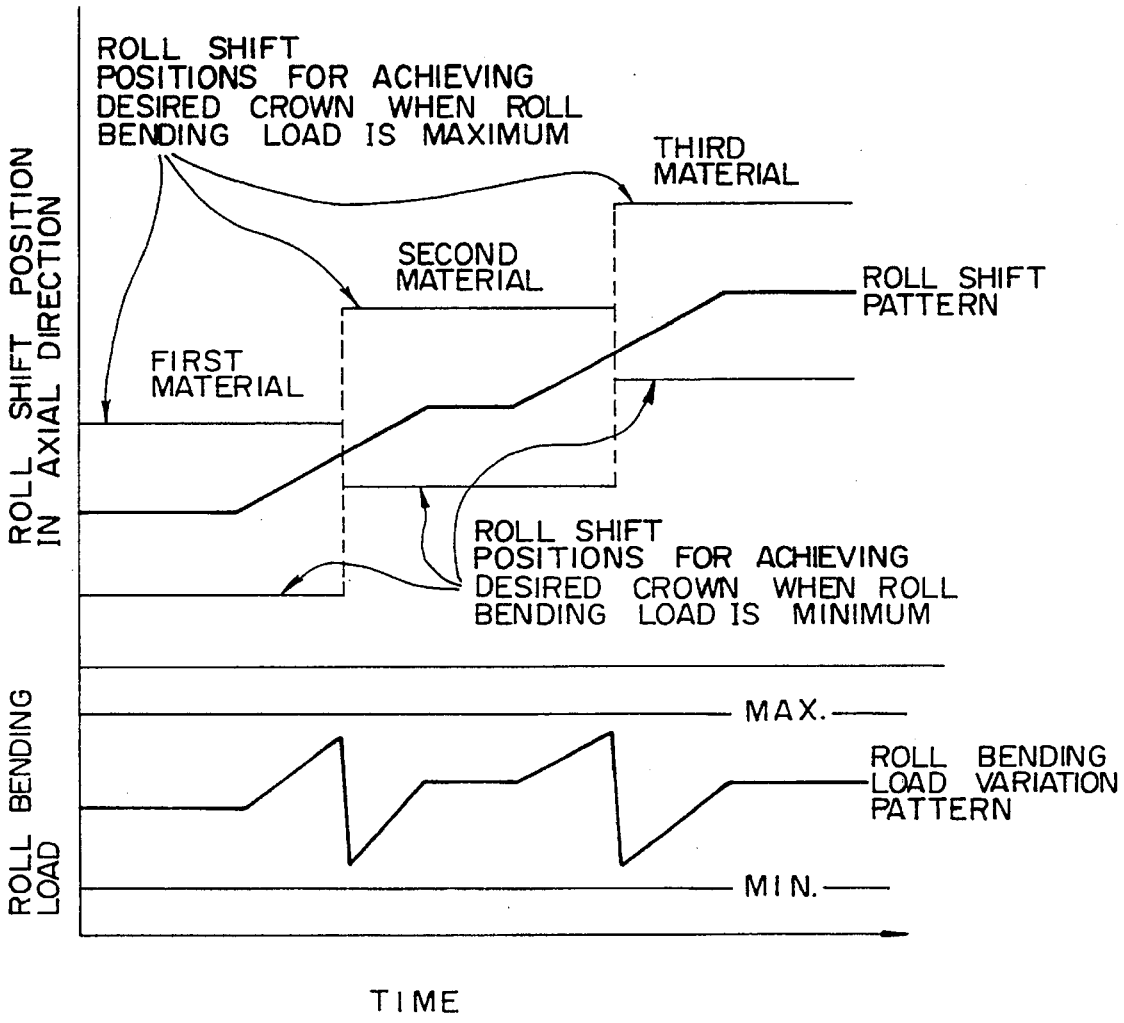
FIG. 3 is a graph indicating roll shift ranges allowing for desired crowns for three neighboring rolling materials, and a roll shift pattern determined within the roll shift ranges, and a roll bending variation pattern in accordance with the roll shift pattern, when there are common roll shift ranges for neighboring materials.

On the other hand, if there is a common roll shift range for neighboring materials as indicated in FIG. 3, the roll position can be shifted within the roll shift ranges for preceding and succeeding materials. More specifically, the roll starts shifting at a portion of the preceding material ahead of the joint portion, and shifts within the common roll shift range, at the joint portion. Thereby, formation of inconsistent portions can be substantially avoided.

Figure 4:
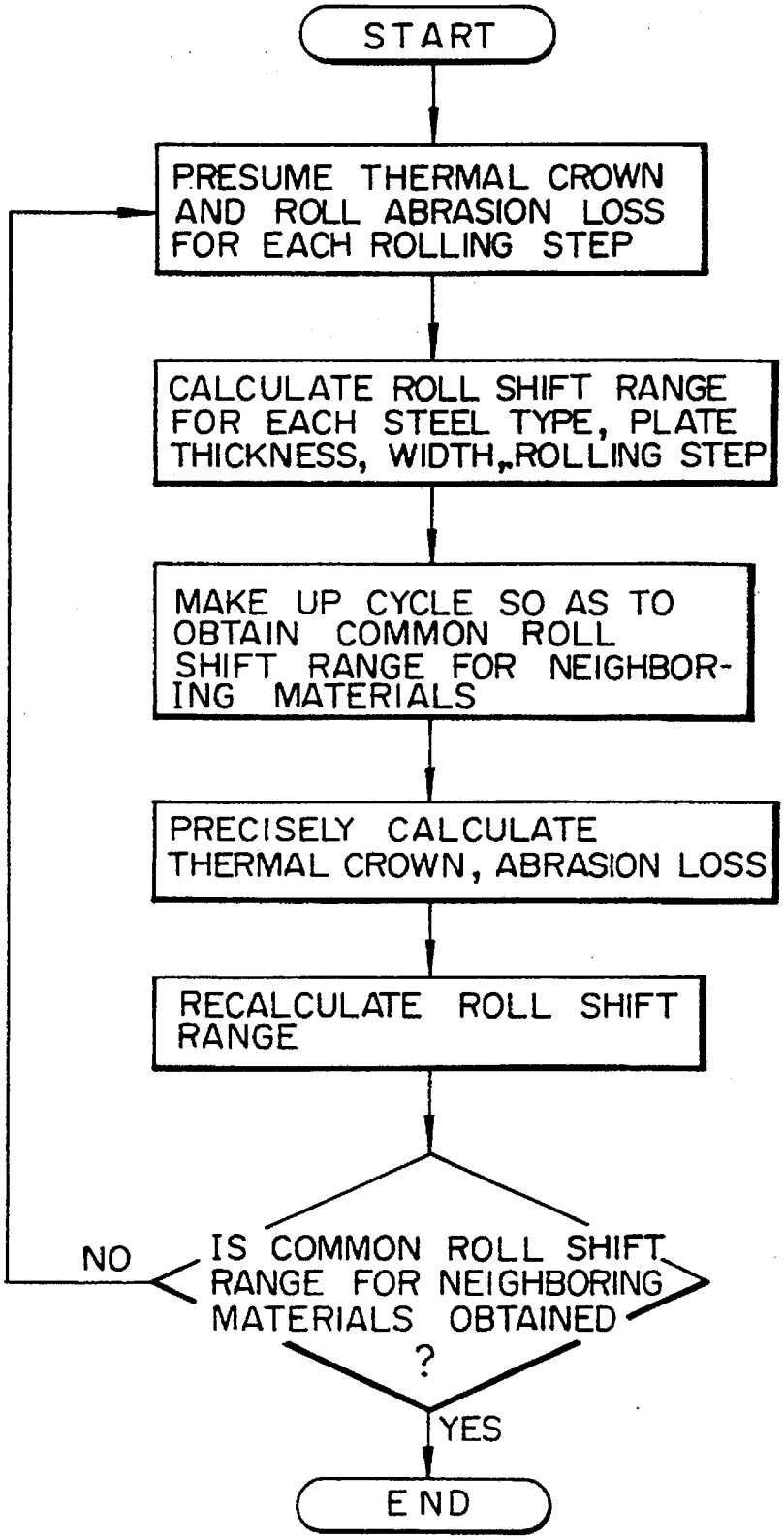
FIG. 4 is a flow chart of a rolling cycle according to the present invention.

The procedure of a rolling cycle according to the present invention will be described with reference to the flow chart shown in FIG. 4.

First, the thermal crown and the roll abrasion loss for each rolling step are presumed. Based on the presumed values, the roll shift ranges according to the steel types, the strip thicknesses, the strip widths, and the sequential rolling steps are calculated so as to achieve desired crowns. Then, the rolling sequence, the steel types, the strip thicknesses and the strip widths are determined so as to obtain common roll shift ranges for neighboring materials in the rolling cycle. The thermal crown and the roll abrasion loss may slightly vary from the presumed values depending on the construction of the rolling cycle. If necessary, the thermal crown and the roll abrasion loss are recalculated. Then, there is a check to determine whether the thus-determined rolling cycle allows for a common roll shift range for each pair of neighboring materials.

Rolling materials can be joined by welding, forge-compressing or fitting, before they are fed into a finishing mill.

Figure 5:
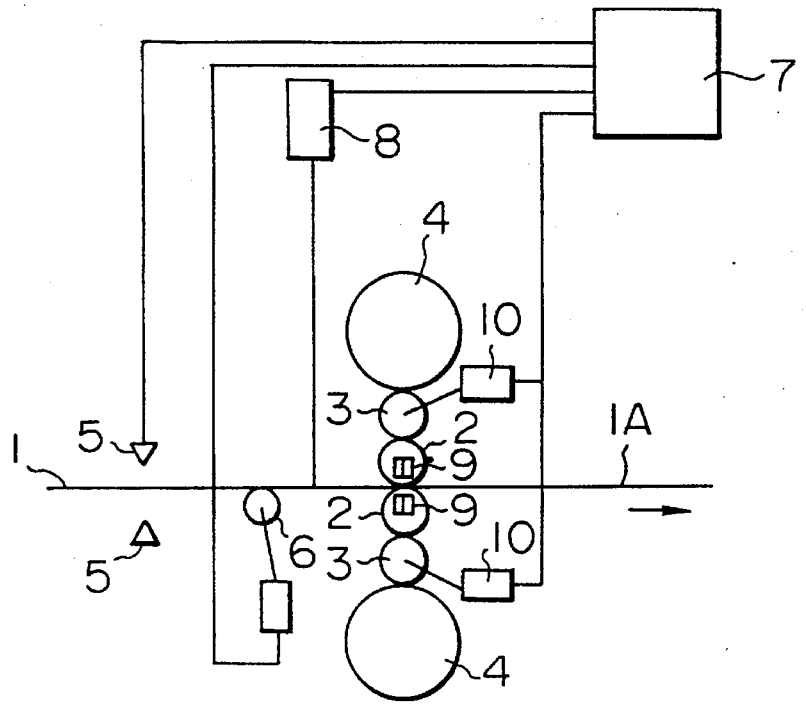
FIG. 5 is a schematic side elevation of a hot finishing mill which is used to carry out the method of the present invention.
Figure 6:
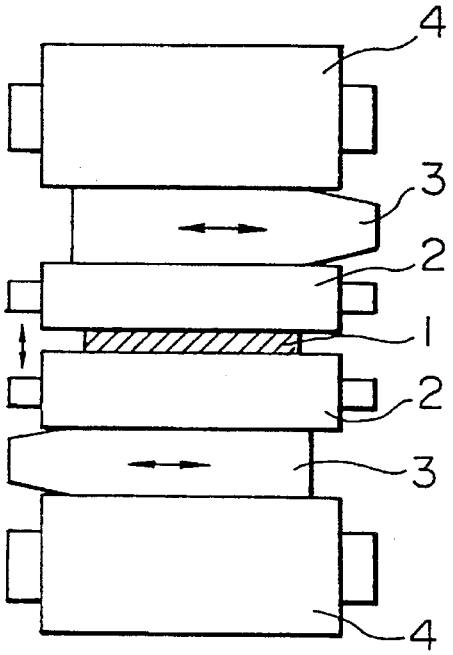
FIG. 6 is a schematic front elevation of a hot finishing mill which is used to carry out the method of the present invention.

A preferred embodiment of the above-described rolling method will be described hereinafter with reference to FIGS. 5 and 6.

When joint detectors 5 provided near the inlet of a hot finishing mill detect a joint portion of a rolling material 1, a detection signal is outputted to a calculator 7.

A material tracking roll 6 composed of, for example, an idle roll and a PLC attached thereto, is provided between the rolling mill and the joint detectors 5, and outputs a detection signal to the calculator 7.

The calculator 7 calculates the timing for entry of the succeeding material 1 into the rolling mill, using the input timing of the detection signal from the material tracking roller 6 as a reference timing. The calculator 7 then calculates a roll shift pattern so that the roll shifts within the common roll shift range, at the joint, and outputs a signal indicating the thus-calculated shift pattern to a device comprising a screw jack and a roll shifting motor for shifting the intermediate rolls 3.

The intermediate rolls 3 are respectively provided with roll position detectors 10 for detecting the positions of the respective intermediate rolls 3 which are axially shiftable. When the intermediate rolls 3 are shifted, the roll position detectors 10 detect the positions of the intermediate rolls 3, and output a detection signal to the calculator 7. To detect an amount of roll shift, each of the roll position detectors 10 uses a PLC attached to the end of the shaft of the roll shifting motor or the screw jack.

Then, the calculator 7 calculates a roll bending load based on values indicated by the signal from the roll position detectors 10, and operates the roll bending cylinders 9 by controlling the opening of the pressure control valve in accordance with the calculated roll bending load value.

Thus, the roll bending load is controlled by the roll bending cylinders 9, which are generally hydraulic cylinders. In other words, the roll bending load is hydraulically controlled.

The hot-rolled steel strip 1A is coiled by a looper which is not shown in Figures. During coiling, the steel strip 1A is cut at the jointed portion.

Although the endless hot rolling method of this embodiment has been described with reference to the six-high finishing rolling mill, it can be applied to a four-high finishing rolling mill comprising a pair of work rolls that are shiftable, and a pair of back-up rolls.

If the roll shift ranges suitable for the desired crowns determined for the respective rolling materials in a single rolling cycle have a common shift range having a width equal to or greater than 50% of the width of the individual shift ranges, endless rolling can be continuously performed in a simplified manner. More specifically, if the rolling cycle is suitably determined and the rolls are positioned within such a common roll shift range before the rolling operation, the rolls do not need to be shifted during the rolling operation, but only the roll bending load needs to be varied so as to achieve the desired crowns, thus easily performing the endless rolling without interruption.

The width of a common roll shift range must be at least 50% of the width of individual roll shift ranges in order to perform endless rolling as described above, because if the common range width is less than 50% of the individual range width, the roll bending means fails to control the roll bending load in response to variations in the external factors that affect the rolling load, such as lubrication conditions, temperature, dimensions, or composition of a rolling material.

In the case where the width of a common roll shift range for neighboring materials is less than 50% of the width of the roll shift ranges for those materials, the rolls are shifted at the joint of the materials, within the common roll shift range, and the roll bending load is accordingly varied.

EXAMPLE 1

Before finish rolling by the finishing mill, the rolling materials were jointed by welding to form endless rolling material units each composed of 20 rolling materials.

200 rolling materials, composed of 10 units, were rolled to obtain the final strip thicknesses of 2–4 mm and the final strip widths of 900–1300 mm by a hot strip mill comprising a three-stand roughing mill and a seven-stand finishing mill. The diameter of the work rolls of the preceding four stands of the finishing mill was 800 mm, and the diameter of the work rolls of the succeeding three stands was 600 mm. The finishing mill had work roll bending means for providing work bending load of ±200 ton f/chock. Each work roll of the finishing mill was tapered from a central portion to one end thereof substantially in the form of a curve of second degree, with a level difference between the central potion and the end being 0.6 mm. The upper and lower tapered work rolls of each stand of the finishing mill were arranged point-symmetrically.

Figure 7:
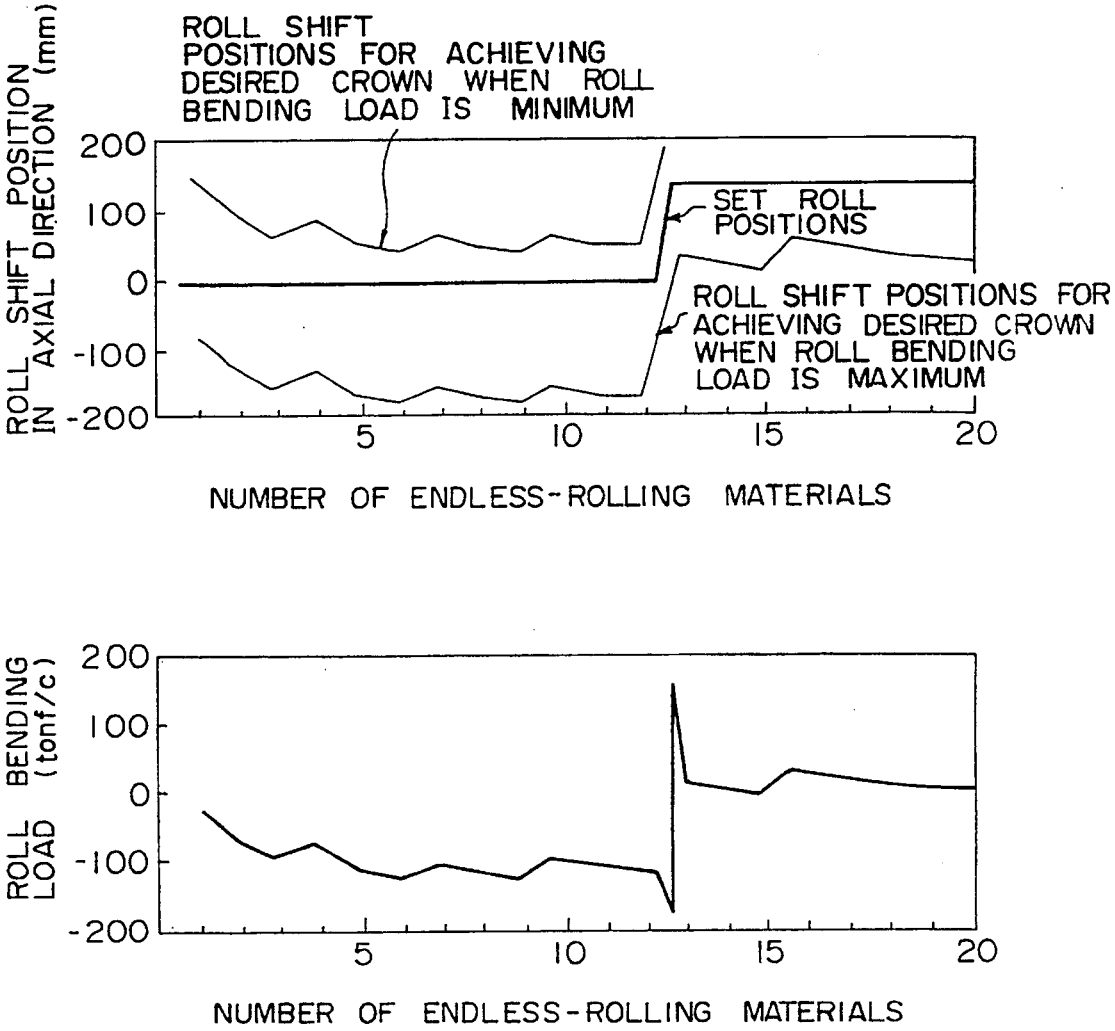
FIG. 7 is a graph indicating the roll shift ranges allowing for desired crowns for neighboring rolling materials, and the roll shift pattern, and the roll bending variation pattern in accordance with the roll shift pattern, corresponding to 20 sequentially-jointed rolling materials.

Endless rolling material unit was rolled according to the rolling cycle, as shown in Table 1, and the roll shift pattern and roll bending load variation pattern as indicated by the graphs of FIG. 7. The roll position was shifted in the axial direction at a joint portion of the twelfth and thirteenth materials, within the common roll shift range for the rolling materials. Continually, the rolling materials were rolled while changing the roll bending load in accordance with the roll shift pattern.

For comparison, a conventional endless rolling method was performed, which omitted the step of checking whether there was a common roll shift range for neighboring materials.

TABLE 1

| No. of Materials (piece) | Steel Type | Strip Width (mm) | Finish Thickness (mm) | F7 Desired Crown (μm) |
|---|---|---|---|---|
| 1–3 | General Type | 1300 | 4.0 | 15 |
| 4–6 | | 1250 | 4.0 | 15 |
| 7–9 | | 1200 | 3.0 | 15 |
| 10–12 | | 1100 | 3.0 | 15 |
| 13–16 | Highly | 900 | 2.0 | 15 |
| 17–20 | Deformation-resistant Type | 800 | 2.0 | 15 |

Figure 8:
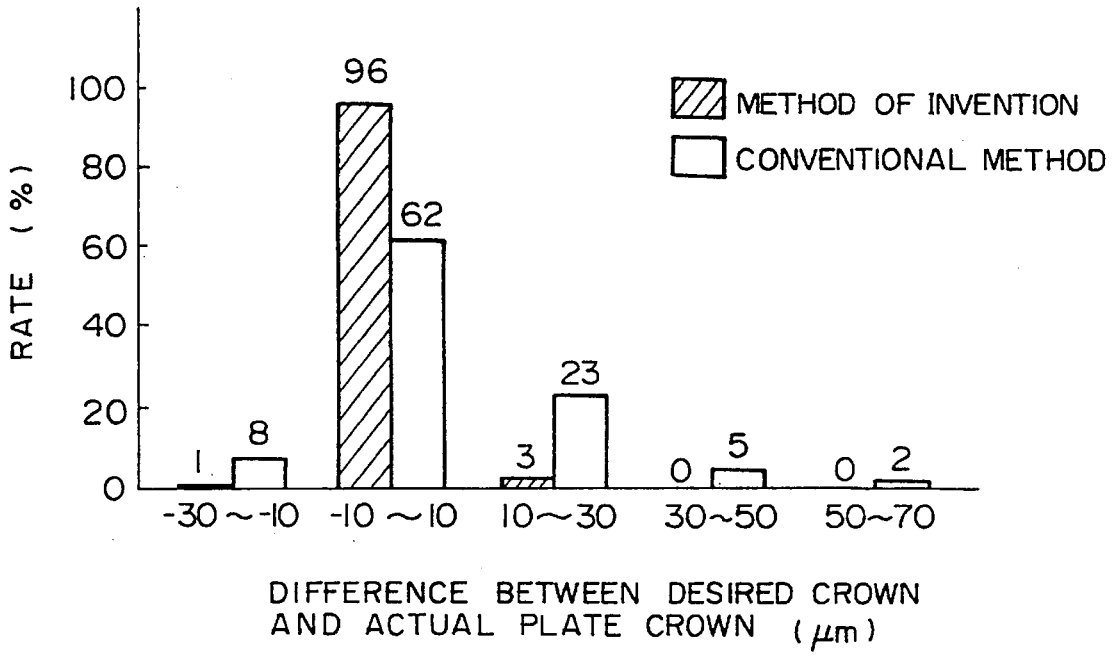
FIG. 8 is a graph indicating the differences between desired crowns and actual plate crowns in the endless hot-rolling method of the present invention and conventional endless rolling method.

FIG. 8 shows the differences between the desired crowns of the steel strips and the actual plate crowns of the steel strips in the endless hot rolling method of the present invention and conventional endless rolling method. The number of strips within each crown difference range is indicated by the proportion thereof to the total number of rolling materials. As indicated by FIG. 8, while a number of the steel strips rolled by the conventional method failed to obtain their respective desired crowns, almost all of the steel strips rolled by the method according to the present invention obtained their respective desired crowns.

EXAMPLE 2

Figure 9:
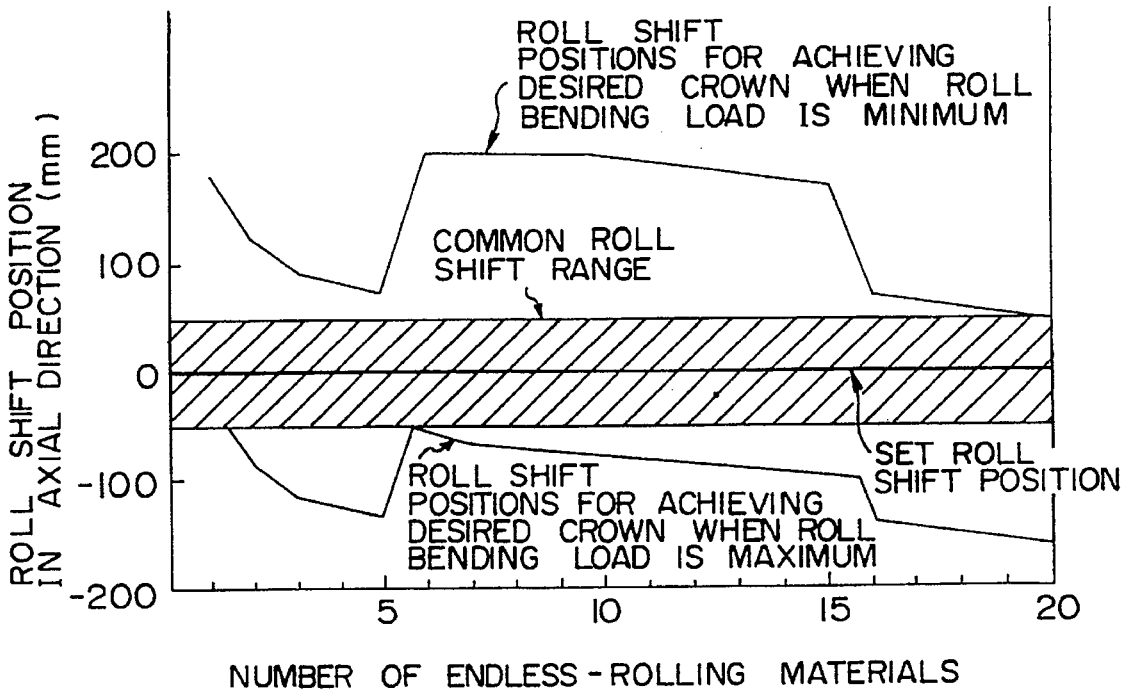
FIG. 9 is a graph indicating the common roll shift ranges for obtaining desired crowns for all (20 pieces) of the materials in an endless rolling cycle.
Figure 10:
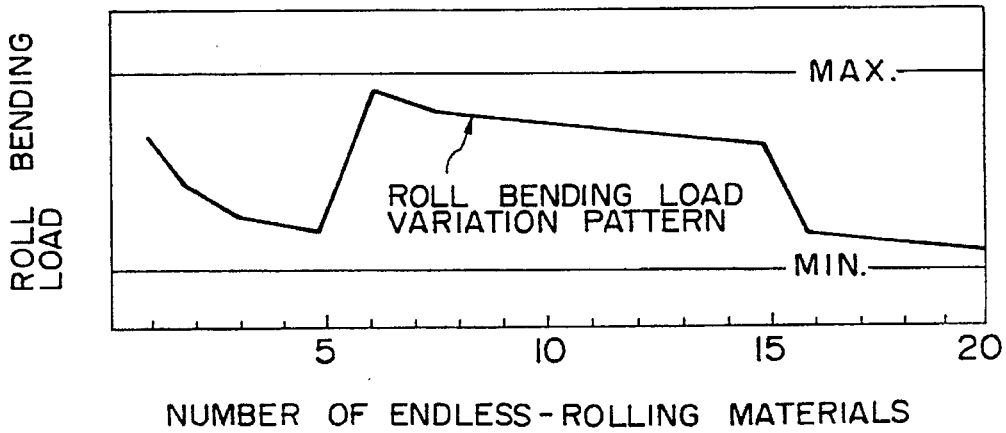
FIG. 10 is a graph indicating the roll bending load variation pattern (20 pieces).

Endless rolling was performed by using the hot finishing rolling cycle as shown in Table 2, which is a combined cycle for general-type materials and highly deformation-resistant materials. Optimal roll shift ranges for obtaining desired crowns of 20 rolling materials were determined so as to obtain a common roll shift range of 20–50 mm for all the rolling materials, as shown in FIG. 9. Before the rolling operation, the roll position was fixed within the common roll shift range. During the rolling operation, the roll bending load was varied for each rolling material so as to obtain the desired crown thereof.

TABLE 2

| NO. of Materials (piece) | Steel Type | Strip Width (mm) | Finish Thickness (mm) | Desired Crown (μm) |
|---|---|---|---|---|
| 1–5 | General | 1300 | 3.0 | 15 |
| 6–15 | Highly Deformation-resistant Type | 1250 | 2.0 | 15 |
| 16–20 | General Type | 1200 | 2.0 | 15 |

As described above, because the endless hot rolling method of the present invention optimizes the construction of the rolling cycle, and shifts the roll position in the axial direction and rolls while changing the roll bending load at joint portions of neighboring materials, the method can achieve desired crowns over the entire length of the sequentially joined rolling materials. In short, the method of the invention is able to substantially avoid formation of inconsistent portions in rolling materials, thereby significantly enhancing the yield.

What is claimed is:

1. An endless hot rolling method using a hot strip mill substantially composed of a roughing mill and a finishing mill having roll bending means and roll shifting means to continuously roll different rolling materials which have been sequentially joined, said endless hot rolling method comprising the steps of:

calculating a roll shift range in an axial direction for each rolling material so as to provide a desired crown for the rolling material;

determining a rolling sequence so as to obtain a common roll shift range for each pair of neighboring rolling materials;

connecting a preceding rolling material at a tail end thereof to a head end of a succeeding rolling material, between the roughing mill and the finishing mill, said connection forming a joint portion of the different rolling materials to be continuously rolled wherein a transition occurs between different steel types and sizes at said joint portion;

shifting in an axial direction a roll position during the continuous rolling and during the transition from the preceding material to the succeeding material so that a roll shift position corresponding to a position at the connection of said preceding material and said succeeding material is within a common roll shift range for said preceding material and said succeeding material; and rolling while changing a roll bending load on each of said roll bending means in accordance with a roll shift pattern so as to achieve the desired crown of each rolling material, thereby suppressing deviation from a target crown at the joint portion where sheet bars of differing steel types are joined for continuous endless rolling.

2. An endless hot rolling method according to claim 1, wherein the rolling material connecting step is performed by means of one of welding or forge compressing.

3. An endless hot rolling method using a hot strip mill substantially composed of a roughing mill and a finishing mill having roll bending means and roll shifting means to continuously roll different rolling materials which have been sequentially joined, said endless hot rolling method comprising the steps of:

calculating an individual axially directed roll shift range having a width for each rolling material so as to provide a desired crown for the rolling material;

determining a roll sequence so as to obtain a common roll shift range for all the rolling materials to be joined having a width equal to at least 50% of the width of each individual roll shift range;

connecting a preceding rolling material at a tail end thereof to a head end of a succeeding rolling material, between the roughing mill and the finishing mill;

shifting in an axial direction rolling means before a rolling operation so that a roll shift position lies within the common roll shift range for all the rolling materials to be joined; and rolling the materials while leaving the rolling means fixed in position in an axial direction, but changing a roll bending load so as to achieve the desired crown of each rolling material and to suppress deviation from a target crown at joint portions where sheet bars of different steel types are joined for continuous endless rolling.

* * * * *